United States Patent [19]

Winter

[11] 4,223,802

[45] Sep. 23, 1980

[54] DEVICE FOR INTRODUCING SMALL OBJECTS IN THE PACKAGING OF ARTICLES

[75] Inventor: Berthold Winter, Hamburg, Fed. Rep. of Germany

[73] Assignee: G.D. Societa per Azioni, Bologna, Italy

[21] Appl. No.: 947,399

[22] Filed: Oct. 2, 1978

[30] Foreign Application Priority Data

Oct. 5, 1977 [DE] Fed. Rep. of Germany ..... 2744760

[51] Int. Cl.[3] ..... B65H 3/24

[52] U.S. Cl. ..... 221/268

[58] Field of Search ..... 221/229, 254, 274, 268, 221/93, 94, 276, 91; 133/5 R, 5 A; 194/2, 10

[56] References Cited

U.S. PATENT DOCUMENTS 1,677,041 7/1928 Mills, Jr. ..... 221/254 X 2,739,603 3/1956 Fry ..... 133/5 R 3,288,331 11/1966 Mazurkivich ..... 221/93 X

*Primary Examiner*—Stanley H. Tollberg

*Attorney, Agent, or Firm*—Cushman, Darby & Cushman

[57] ABSTRACT

A device for enclosing small objects such as coins when packing articles such as cigarette packets in a packaging machine, comprises a feed chute for the coins, a delivery chute in communication with the feed chute and containing a reciprocatable push rod to move the coins through the delivery chute, and a plate above the delivery chute outlet. The plate has a slot to permit the passage of the coins which are moved through the delivery chute and is reciprocatable in the feed direction of the cigarette packets so as to move between a first position blocking the delivery chute outlet and a second position in which the delivery chute outlet is open for the passage of the coins.

Separate delivery chutes may be situated in parallel vertical planes, with a connecting feed chute between coplanar delivery chutes.

6 Claims, 3 Drawing Figures

DEVICE FOR INTRODUCING SMALL OBJECTS IN THE PACKAGING OF ARTICLES

BACKGROUND OF THE INVENTION

This invention relates to a device for introducing small objects in the packaging of articles, and is particularly applicable to the introduction of coins into cigarette packets.

In the packaging of articles by packaging machines, the inclusion of small objects, such as coins, toys, small objects of plastics material, sweets and the like during the packaging operation encounters substantial difficulties where high-speed packaging machines are used and, in particular, becomes virtually impossible in the case of existing large and expensive packaging machines. The insertion of small objects by hand, for example at the stage prior to sealing or sticking the final segment of the folded wrapping sheet, usually at the end face of the package which is otherwise completely enclosed by all the folded regions of the wrapping sheet with the exception of, for example, the said end face, is an expensive operation and also requires an interruption of the packaging cycle. Merely depositing the small objects onto the articles delivered into the packaging machine usually results in loss of some of these small objects by detachment from the articles being packaged in the case where high-speed packaging machines are used; this is just as unsatisfactory as sticking the objects onto the package before the latter is enclosed by the wrapping sheet, which may well result in damage to the packages or to the small objects.

The basic object of the present invention is to provide a device by means of which it is possible to insert small objects into packages in conventional packaging machines without difficulty, and which can be used with high-speed packaging machines having a throughput of more than 100 to 400, for example 260, packages per minute, whilst otherwise maintaining the normal operation cycle of the packaging machine. The inventive device finds particular application in the packaging of cigarettes for sale in automatic vending machines where it is often necessary to round off the selling price of the packet by including small coins making up the cost to the nearest whole number of larger-value coins.

SUMMARY OF THE INVENTION

According to the present invention there is provided a device for enclosing small objects when packing articles in a packaging machine and comprising a feed chute for the small objects, and a delivery chute in communication with the feed chute and containing a reciprocatable push rod to move the small objects through the delivery chute, characterized in that there is provided at the delivery chute outlet a member having at least one opening shaped to permit the passage of the small objects which are moved through the delivery chute, said member being reciprocatable in the feed direction of the articles to be packaged, so as to move between a first position blocking the delivery chute outlet and a second position in which the delivery chute outlet is open for the passage of the small objects.

Preferably, said member comprises a flat plate above the delivery chute outlet and formed with at least one slot.

Preferably also, said push rod is reciprocatable between a lower end position and an upper end position and said feed chute leads into the delivery chute at a position closely adjacent the lower end position of the push rod which, when in its upper end position, blocks the outlet of the feed chute.

Separate delivery chutes may be provided, situated in parallel vertical planes having a relative spacing exceeding the thickness of the small objects, and a connecting feed chute being provided between the delivery chutes.

DESCRIPTION OF PREFERRED EMBODIMENTS

Figure 1:
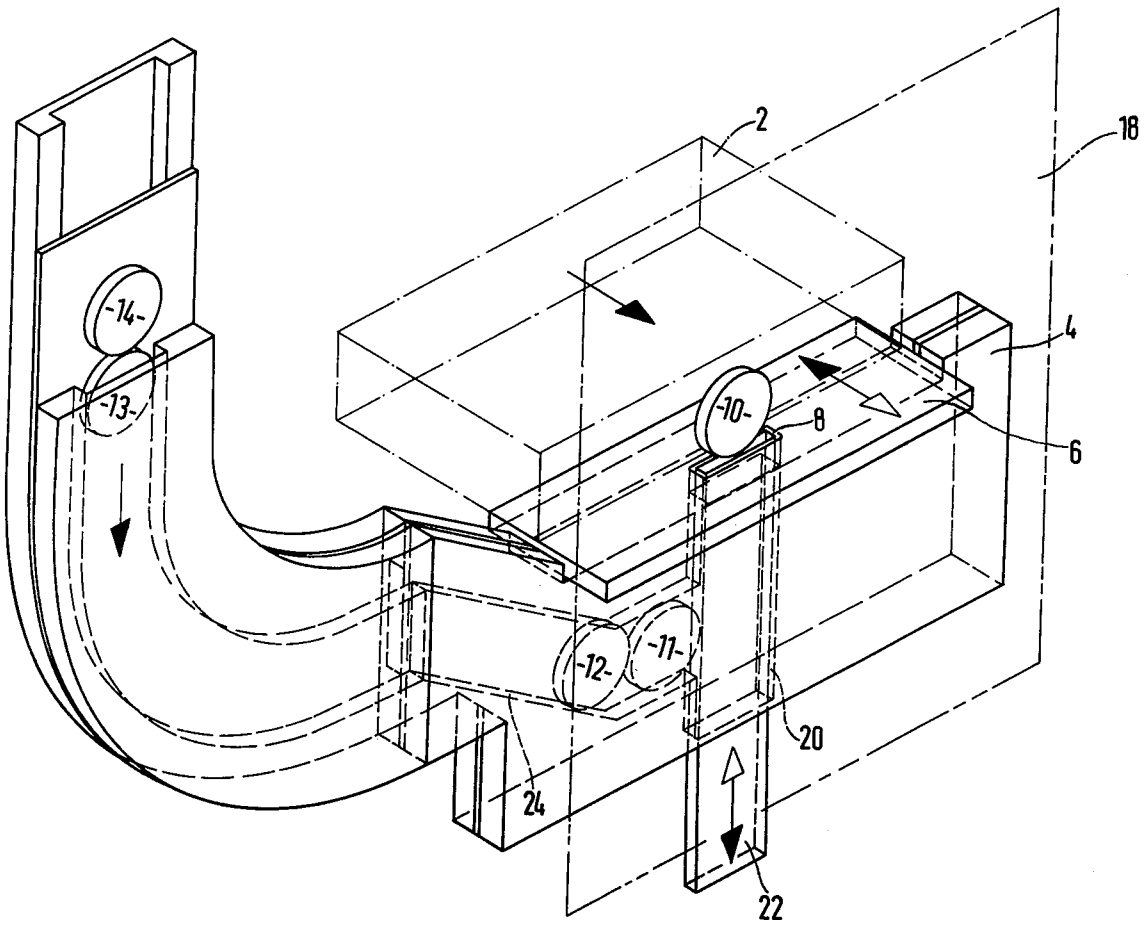
FIG. 1 is a schematic diagram showing one form of device according to the invention, for dispensing coins into packages, the device being illustrated in the delivery position.

Referring to the drawings, the dispensing device shown in FIG. 1 is based on the requirement that, during the packaging operation and before the wrapping of the package with paper or cellophane, one coin is to be inserted at the longitudinal side of each package.

The article 2 which is to be packed, in the present case a packet of cigarettes, is guided towards a suspended sheet 18 of cellophane which, at a subsequent operation not shown in the drawing, is wrapped around the cigarette box, folded and then stuck or sealed at the folded segments.

The dispensing device according to the invention is arranged in advance of the suspended sheet 18 of cellophane, and comprises a frame 4 upon which a plate 6 is reciprocatable in the feed direction of the article 2 which is to be packaged. In the plate 6 there is provided a number of slots 8 corresponding to the number of small objects which are to be dispensed to each package. In the present case there is a single slot, out of which a small object in the form of a coin 10, from a delivery chute 20, can be ejected by means of a push rod 22. The width and length of the slot exceed somewhat the corresponding dimensions of the small objects to be dispensed.

The feeding of the coins takes place through a feed chute 24, the mouth of which leads into the delivery chute 20 at a position above the push rod 22 when the latter is in its bottom position. Further coins 11, 12, 13 and 14 are assembled in "ready" positions in the feed chute 24.

The operation of the device according to the invention will now be described with reference to FIGS. 1 and 2. In FIG. 1, the device is shown in the delivery condition; the push rod 22 has reached its top position and has raised the coin 10 through the slot 8 in the plate 6, so that this coin now assumes a vertical position between the wrapping material 18 and the arriving package 2. The package, together with the coin, is pushed against the wrapping sheet 18 and then further conveyed through the subsequent folding and sealing stages of the packaging machine for completing the packaging operation. In this delivery condition, the push rod 22 blocks the delivery of a further coin 11 from the feed chute 24. The coins being delivered by the push rod 22 do not tilt, because of the rapid completion of the steps in the working cycle when the coins are held at the one side by the side wall of the package 2 and at the other side by the wrapping sheet 18.

Thereafter, the push rod 22 moves downwardly; the plate 6 is displaced towards a newly delivered package, the slot 8 then being blocked and the chute 20 being freed for the entry of a further coin 11.

Figure 2:
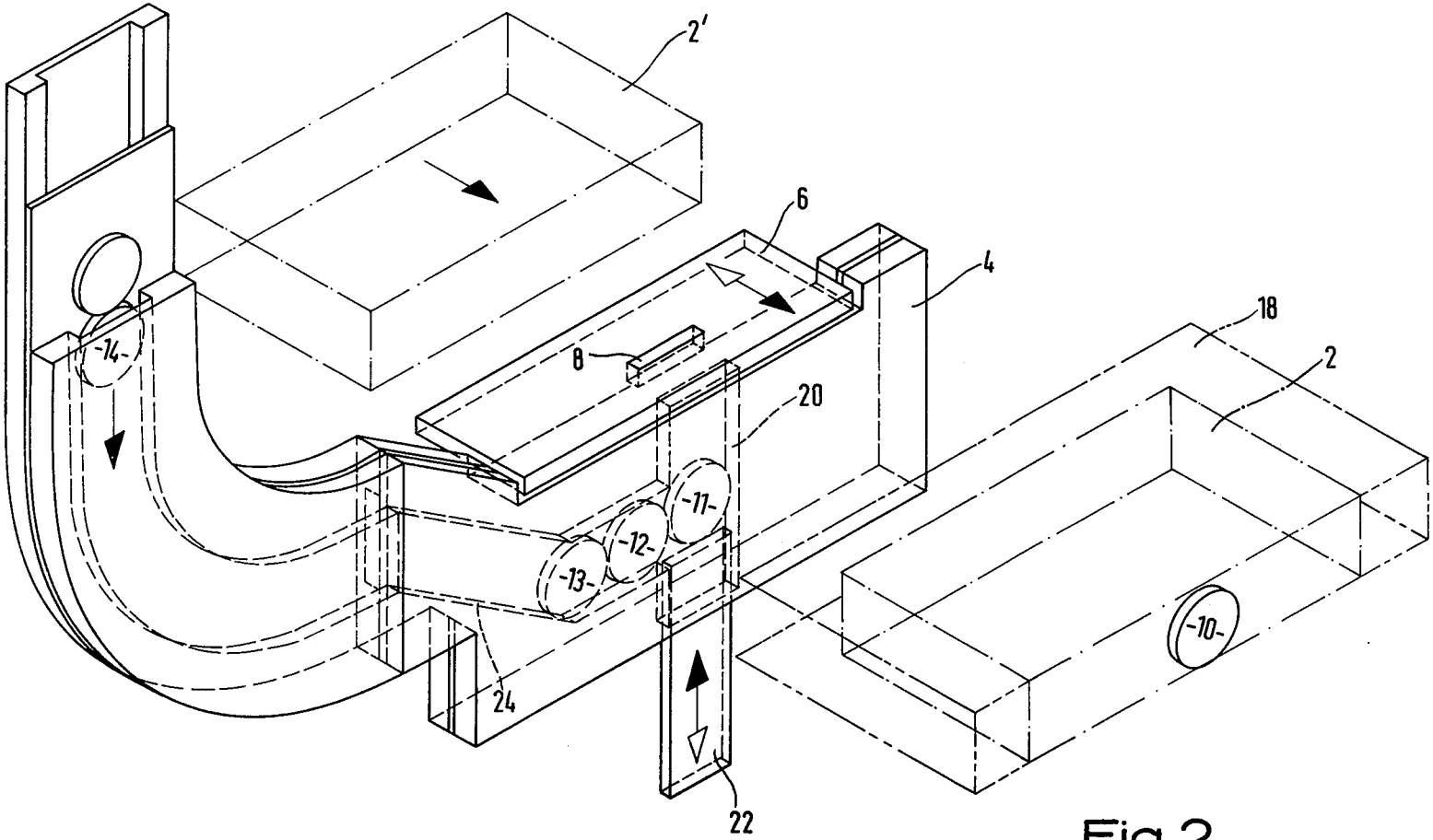
FIG. 2 is a diagram corresponding to FIG. 1, but showing the blocked position after the inclusion of a single coin in the package; and, FIG. 3 is a diagram similar to FIG. 1, showing another form of device according to the invention, for delivering several coins to each package.

FIG. 2 shows the final blocking position in which the push rod 20 is situated in its bottom position and the plate 6 is situated in its rearward end position. In this end position, when the plate is under the control of, for example, cams, the push rod 22 and the plate 6 remain for such time as a new package 2 and a new piece of the wrapping sheet 18 have been presented by the packaging machine. Also during this dwell period, the row of coins in the feed chute 24 steps forward through the distance of one coin so that the coin 11 arrives in the delivery chute 20. Any uncontrolled ejection of this coin is rendered impossible in this position because the plate 6 is in its rearward end position. When the package 2 reaches a predetermined position in the packaging machine, the plate 6 moves into its forward end position and the push rod displaces the newly presented coin 11 to bring it in front of the newly arrived package 2.

Therefore, the plate 6 serves the functions of, firstly, blocking the delivery chute 20 and, secondly, bridging over the intervening space to where the wrapping sheet 18 is suspended whilst the coin is being conveyed forwardly by the package.

Obviously, it is possible to bring the plate 6 into the blocking position by displacing it either in the feed direction of the article 2 which is to be packaged, or transverse to that direction.

Figure 3:
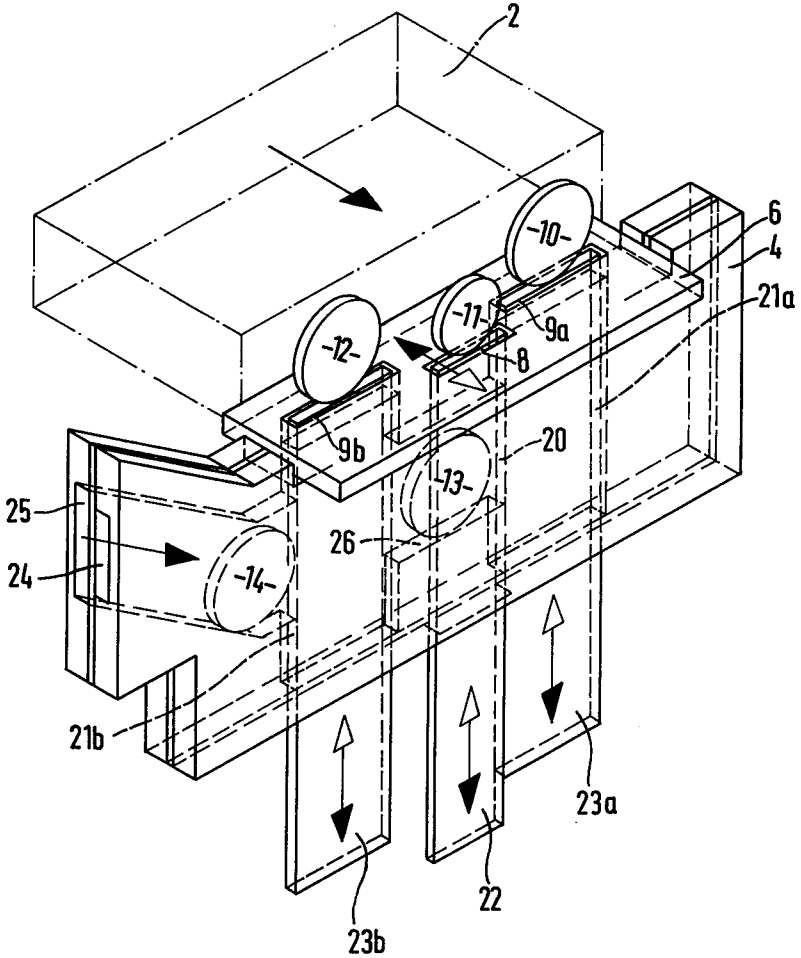

In the embodiment of the invention shown in FIG. 3, it is possible to dispense three coins into each package. In this arrangement, in addition to the delivery chute 20 with the push rod 22 and slot 8, there are provided two further delivery chutes 21*a* and 21*b* with respective push rods 23*a* and 23*b*, and two correspondingly positioned slots 9*a* and 9*b* in the plate 6. The additional chutes 21*a* and 21*b* are arranged in a vertical feed and delivery plane which is parallel to and spaced from the other vertical feed and delivery plane containing the chute 20, the push rod 22 and the slot 8, by a distance which somewhat exceeds the thickness of the small object.

The feed of coins takes place through the feed chute 24 in the same way as in the device according to FIGS. 1 and 2 and, for the sake of a clear showing of the present embodiment, no coins are shown in the ready position in chute 24. The feed of coins also takes place through a feed chute 25, to supply the delivery chutes 21*a* and 21*b*.

The device shown in FIG. 3 is in the delivery position, the push rod 22 having ejected the coin 11 upwardly out of the chute 20 through the slot 8, and the push rods 23*a* and 23*b* having ejected the coins 10 and 12 upwardly through the chutes 21*a* and 21*b* into the delivered positions. The supply of coins for the delivery chutes 21*a* and 21*b* takes place from the feed chute 25, whilst a further connecting feed chute 26 is provided as an extension of the feed chute 25 so that the delivery chutes 21*a* can be supplied with a coin. As illustrated coin 13 is situated in the connecting chute 26 and, after the lowering of the push rod 23*a* arrives in the chute 21*a*; simultaneously coin 14 in the feed chute 25, and a further coin not shown here, fill the connecting feed chute 26 and the delivery chute 21*b* respectively.

Numerous modifications are possible. The number of coins or other small objects, and the type and form thereof can be varied according to requirements. Furthermore, according to the type of packaging machine which is employed, the small objects can be applied to the longitudinal face, the end face, or the upper or the lower side of the package.

I claim:

1. A device for enclosing small objects when packing articles in a packaging machine, the device comprising a feed chute for said objects, a delivery chute in communication with said feed chute and having an outlet, a reciprocatable push rod slidably mounted in the delivery chute to move said objects through the delivery chute in a controlled manner, and a separate member positioned between the delivery chute outlet and the articles being packaged, said separate member having means defining at least one opening therein for permitting the passage of said objects therethrough which have been moved through the delivery chute, said separate member being reciprocatable in the feed direction of said articles between a first position blocking the delivery chute outlet and a second position in which the delivery chute outlet is aligned with said means defining at least one opening.

2. A device according to claim 1, in which said separate member comprises a flat plate above the delivery chute outlet and formed with at least one slot.

3. A device according to claim 1, in which said push rod is reciprocatable between a lower position and an upper position and said feed chute leads into the delivery chute at a position closely adjacent the lower position of the push rod which, when in its upper end position, blocks the outlet of the feed chute.

4. A device according to claim 1, in which separate, spaced apart, delivery chutes are situated in parallel vertical planes, each chute having a relative spacing exceeding the dimensions of said objects, and a connecting feed chute provided between delivery chutes located in respective planes.

5. A device according to claim 4, in which two delivery chutes situated in a first vertical plane have a distance between them which exceeds the width of an intervening delivery chute which lies in a second vertical plane spaced from said first vertical plane.

6. A device for inserting coins between a cigarette package and a cover therfor during packaging in a packaging machine, the device comprising feed chute means for feeding coins along a predetermined path, delivery chute means in communication with said feed chute means defining a path along which the coins are moved toward the package, said delivery chute means having an outlet, a reciprocatable push rod mounted in said delivery chute means to move the coins through the delivery chute in a controlled manner, plate means mounted above said delivery chute means outlet for controlling the passage of coins from said delivery chute means outlet toward said package, said plate means having at least one opening to permit the passage of coins therethrough, said plate means being reciprocatable in the feed direction of said packages between a first position blocking said delivery chute means outlet and a second position in which said delivery chute means outlet is aligned with said at least one opening.

* * * * *